United States Patent [19]

Simpson

[11] 4,241,950

[45] Dec. 30, 1980

[54] FOLDING CHAIR

[76] Inventor: Douglass E. Simpson, 2426 W. 6th Ave., Vancouver, B. C., Canada, V6K 1W3

[21] Appl. No.: 36,154

[22] Filed: May 4, 1979

[51] Int. Cl.[2] ..... A47C 4/00

[52] U.S. Cl. ..... 297/18; 297/56; 297/39

[58] Field of Search ..... 297/18, 55, 56, 39, 297/16

[56] References Cited

U.S. PATENT DOCUMENTS

| | | | |
|---|---|---|---|
| 585,422 | 6/1897 | Boenning | 297/18 |
| 870,260 | 11/1907 | Thomas | 297/18 |
| 898,235 | 9/1908 | Lloyd | 297/56 X |
| 1,377,600 | 5/1921 | Prest | 297/18 |
| 1,945,580 | 2/1934 | Turnai | 297/18 |
| 2,675,059 | 4/1954 | Martin | 297/18 |
| 2,709,482 | 5/1955 | Schlaak | 297/55 X |
| 2,920,687 | 1/1960 | Hurley | 297/56 X |
| 3,154,344 | 10/1964 | Stableford | 297/18 |
| 3,220,764 | 11/1965 | Duer | 297/56 |
| 3,822,913 | 7/1974 | Raver | 297/18 |

*Primary Examiner*—Roy D. Frazier

*Assistant Examiner*—Peter A. Aschenbrenner

*Attorney, Agent, or Firm*—Carver and Company

[57] ABSTRACT

Folding chair structure having four legs, seat portion supported by lateral seat members, and back portion supported by lateral back members hinged to seat members. Forward leg members extend upwardly and rearwardly from a forward position on floor and are hinged at rear of seat portion and then extend upwardly as the lateral back members. Rear leg members extend upwardly and forwardly from a rear position on floor and are hinged at front of seat so that when viewed laterally, forward and rear leg members cross each other at an intersection. Cross links are hinged between respective forward and rear leg members on each side of the chair and below the intersection and, in combination with leg members and lateral seat members, provide a crossed four-bar mechanism below seat. Forward arm support is hinged to forward seat portion and support arm members which are also hinged to back portion, to form a four-bar mechanism approximating to a parallelogram above the seat. Chair provides many stable positions for user which are attained merely by user shifting his weight, while sitting, i.e., without getting up from seat.

11 Claims, 7 Drawing Figures

FOLDING CHAIR

BACKGROUND OF THE INVENTION

1. Field of Invention

This invention relates to a folding chair which can be folded from a variable operative or upright position to a folded position in which the chair assumes a generally flat configuration.

2. Prior Art

There are many types of folding chairs available and these can be classified into two main types, namely semi-reclining and upright types. This first or semi-reclining type is commonly called a deck chair in which a strip of fabric extends longitudinally between a pair of spaced transverse members adjacent the head and thighs of the person using the chair. The geometry of the deck chair can be varied, usually when the chair is unoccupied, by raising or lowering the upper transverse member relative to the lower transverse member so as to provide a more upright or reclining position respectively for the user. The second or upright type of chair includes two common forms, for example, patio chairs and "director's chairs". Both common forms of upright chairs are essentially non-variable once set up, that is the seat and back portions remain in essentially fixed positions relative to each other.

Both main types of chairs as above exemplified suffer from the disadvantage that, once the chair is set up, the geometry of the chair is essentially fixed unless the person using the chair gets up and makes some adjustments. Each chair resists a stable rocking tendency in the fore and aft direction which contrasts with the traditional non-folding rocking chair. This resistance prevents the person from shifting to a more comfortable position by changing the relative angles between the front and back portions of the chair and the horizontal.

Also, these types of folding chairs require fabric support members which support the back and seat fabric panels. Commonly, two or four fabric support members are either generally co-planar with or spaced from the fabric and, when the fabric carries a load it deforms or sags, and the person's body sometimes tends to interfere with the fabric support members, making the seat and/or back uncomfortable for use for long periods.

SUMMARY OF THE INVENTION

The invention reduces difficulties and disadvantages of the prior art by providing a folding chair in which the geometrical relationship between the seat and the back can be varied in the operative position to permit the user to assume any position between an upright position and a semi-reclining position without leaving the seat. The upright position is similar to a normal easy chair in which the user's lower legs are inclined to the user's upper legs at a right angle or a relatively small obtuse angle close to a right angle. In the reclined position, the user's feet are spaced as far from the chair as is comfortable so that the user's upper and lower legs assume a larger obtuse angle or almost a straight line. Furthermore, the chair can assume any position between the two extreme positions as disclosed above whilst the user remains seated, and when the chair is not in use it can be folded to assume an almost flat folded configuration. Furthermore, in one embodiment, the seat and back fabric portions are supported on lateral margins thereof by fabric supporting members which are held apart laterally by transverse members positioned below the fabric so as not to interfere with the fabric as it deforms under load.

The folding chair structure according to the invention has legs, a seat portion and a back portion, and is adapted to be unfolded from a folded position to an operative position. In the operative position the seat portion includes generally horizontal right hand and left hand lateral seat members adapted to support seat material therebetween, and the back portion includes upwardly extending right hand and left hand lateral back members. The back members are hinged to the respective seat members and adapted to support back material extending therebetween. The chair is further characterized by a forward leg pair, a rear leg pair, right hand and left hand cross links, a forward arm support pair and an arm member pair.

The forward leg pair has right hand and left hand inclined, generally parallel forward leg members extending upwardly and rearwardly from a position generally below a forward portion of the seat portion. The forward leg members are hinged at aligned rear hinge points generally adjacent to the rear portion of the seat portion. The forward leg members extend essentially rigidly from the respective lateral back members adjacent the rear hinge point so as to be inclined at an obtuse angle to the back members to form right hand and left hand combination members. A first transverse means connects the combination members together. The rear leg pair has right and left hand inclined, generally parallel, rear leg members extending upwardly and forwardly from a position generally beneath the rear of the seat portion. The rear leg members are hinged at aligned forward hinge points adjacent to the forward portion of the seat portion and a second transverse means connects the rear leg members together. When viewed laterally, the forward and rear leg members appear to cross each other at an intersection. The right hand and left hand cross links are hinged to extend between the right hand forward and right hand rear leg members, and between the left hand forward and left hand rear leg members respectively, the cross links being positioned below the intersection of the leg members. The forward arm support pair has generally parallel right hand and left hand forward arm support members hinged to the seat portion generally adjacent to the forward hinge point to extend upwardly therefrom. The arm member pair has generally horizontal right hand and left hand arm members hinged adjacent forward portions thereof to the respective forward arm support members and adjacent rear portions thereof to the lateral back members.

A detailed disclosure following, related to drawings, describes a preferred embodiment of the invention, which however is capable of expression in structure other than that described and illustrated.

DETAILED DISCLOSURE

Figure 1:
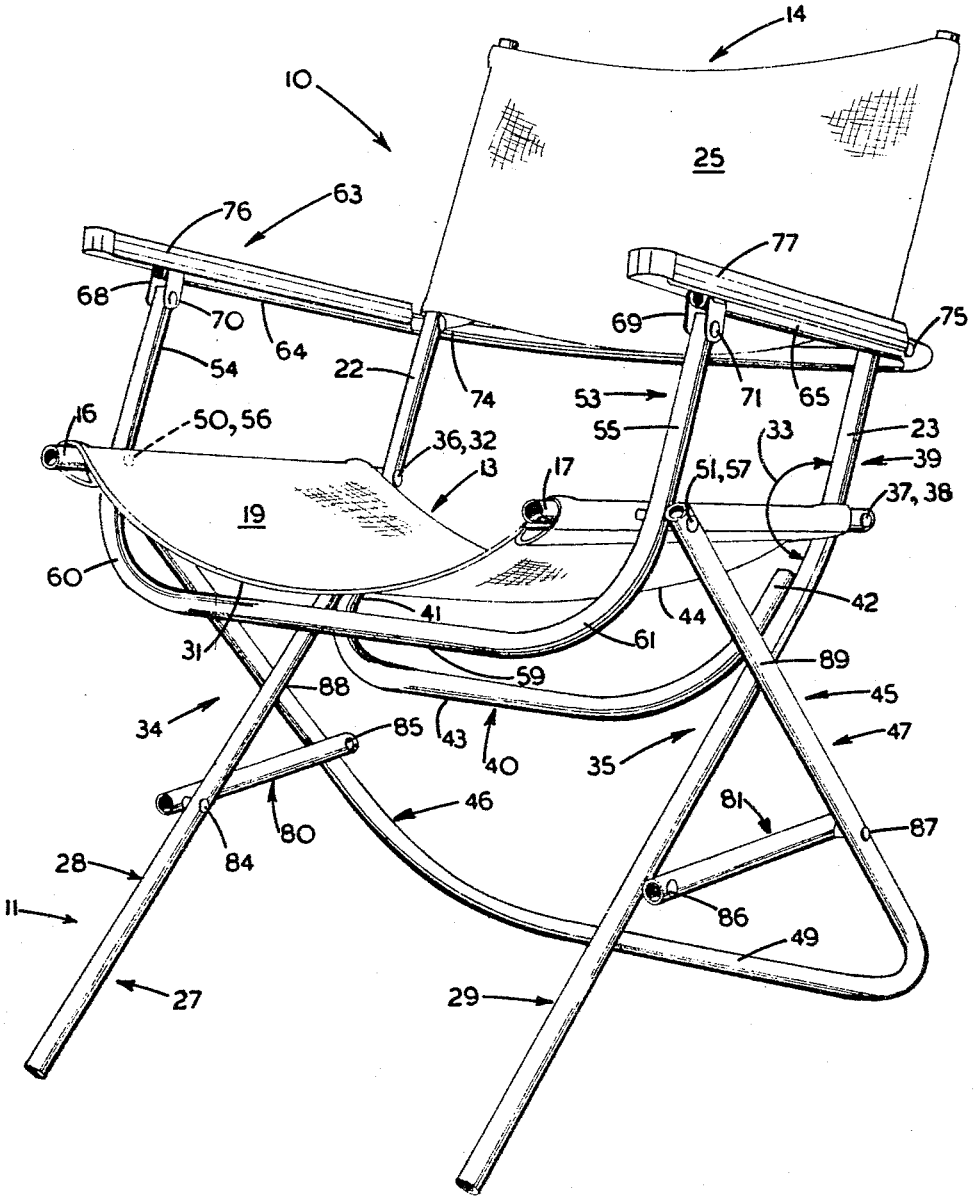
FIG. 1 is a perspective of the chair in an intermediate operative position.
Figure 2:
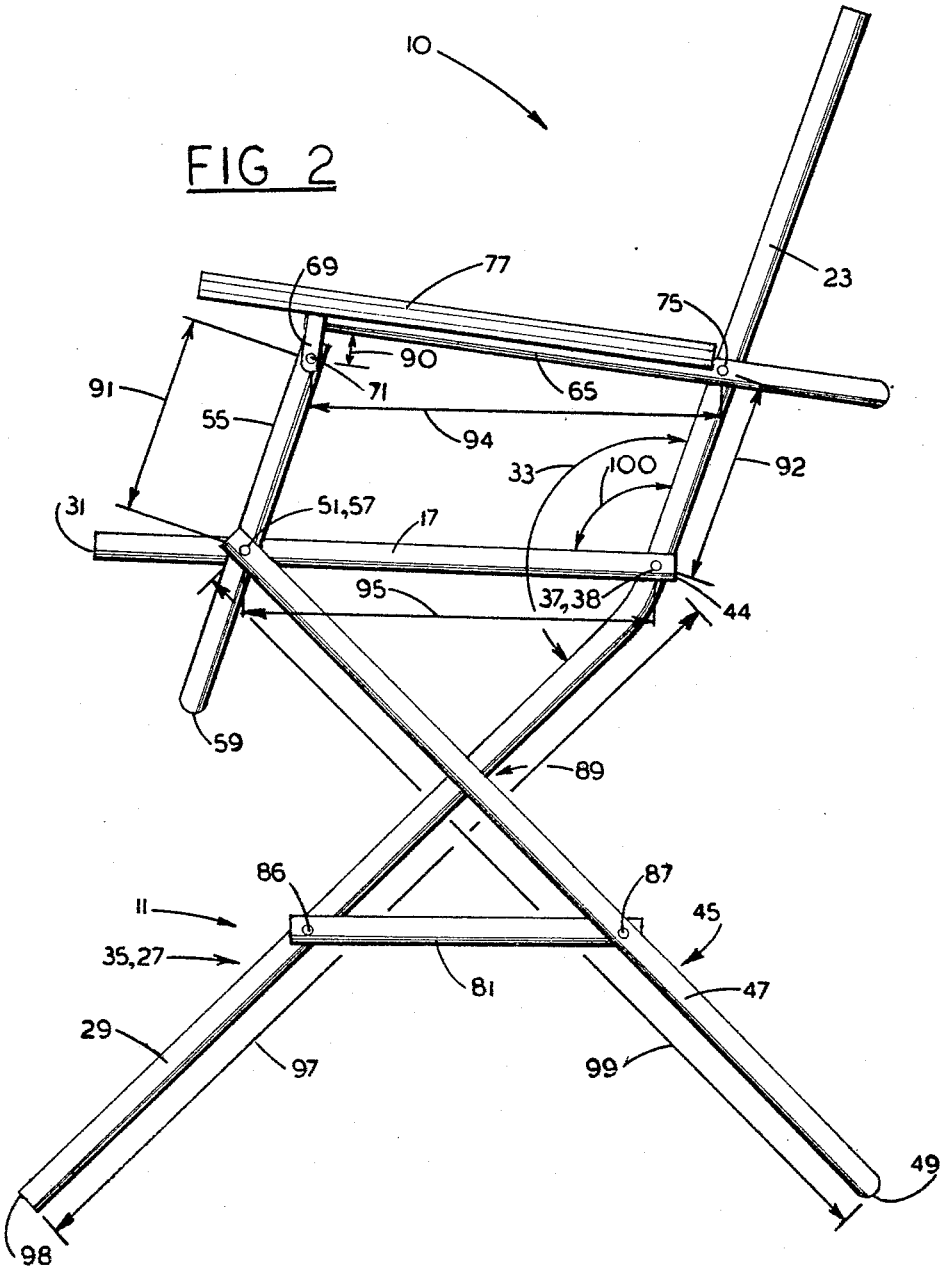
FIG. 2 is a simplified side elevation of the chair with seat and back fabric removed, the chair being shown in the intermediate operative position of FIG. 1.

FIGS. 1 and 2

A folding chair 10 according to the invention has a plurality of legs 11, a seat portion 13 and a back portion 14. The chair is shown in an operative position with the seat portion in a generally horizontal position, but this is variable between oppositely inclined positions as will be described. The seat portion 13 has generally parallel right hand and left hand lateral seat members 16 and 17 adapted to support a panel of seat material 19 therebetween. The back portion 14 includes upwardly extending and generally parallel right hand and left hand lateral back members 22 and 23 adapted to support a panel of back material 25 therebetween.

The plurality of legs includes a forward leg pair 27 having right hand and left and inclined, generally parallel forward leg members 28 and 29 extending upwardly and rearwardly from a position generally below a forward portion 31 of the seat portion 13. The right hand and left hand forward leg members are integral with the right hand and left hand lateral back members of the back portion, i.e. each of the right hand members is a portion of a continuous right hand combination member 34, ie. a tube, and each of the left hand members is similarly a portion of a continuous left hand combination member 35. Each leg member is inclined to the respective back members at an angle 33 which, in the example shown is about 155 degrees, but this angle can be within a range of between about 145 degrees and about 165 degrees. Thus, it can be seen that the lateral back members extend essentially rigidly from the respective forward leg members so as to be inclined at an obtuse angle to the respective leg members. The lateral members are thus formed into shallow 'V' shaped members where one arm of the 'V' is a lateral back member and the other arm of the 'V' is a forward leg member. The forward leg members and the back members effectively intersect at the point of the 'V' which is adjacent a rear hinge point at which the lateral back members or, in fact, the forward leg members, are hinged to the respective seat members. A right hand rear hinge point is designated 36 and a transversely opposite left hand rear hinge point is designated 37. The rear hinge points 36 and 37 have right hand and left hand rear hinge pins 32 and 38, openings in the members and hinge pins being reinforced as required to bear loads.

A first 'U' shaped transverse member 40 extends between upper portions of the right hand and left hand forward leg members 28 and 29 respectively, so as to be generally adjacent to the intersection of the forward leg members and respective lateral back members. The transverse member 40 has upwardly extending end portions 41 and 42 which are secured adjacent and parallel to the leg members to connect the combination members 34 and 35 together. The member 40 is positioned so that a mid-portion 43 of the member 40 is spaced sufficiently below the seat portion 13 so that when a user sits on the chair, downward deflection or sagging of the seat portion 13 does not cause interference with the middle portion 43. Thus it can be seen that the first transverse member connects together the forward leg members generally below the seat portion to form a rearwardly inclined 'H' shaped frame 39 with the lateral back members forming an upper portion of the 'H' shaped frame 39 and the forward leg members forming a lower portion of the frame.

The plurality of legs 11 includes a rear leg pair 45 having right hand and left hand inclined, generally parallel rear leg members 46 and 47 extending upwardly and forwardly from a position generally beneath a rear portion 44 of the seat portion 13. A second transverse means 49 connects lower portions of the rear leg members together and is, in fact, an inward extension of the rear leg members which are in one piece and are connected together adjacent lower portions of the rear leg members to form a generally flat-bottomed 'U' shaped frame.

The rear leg members 46 and 47 are hinged at forward hinge points 50 and 51 respectively to the lateral seat members 16 and 17, the hinge point 50 being shown in broken outline and is disposed transversely opposite to the hinge point 51. A forward arm support pair 53 is sandwiched between the lateral seat members 16 and 17 and the rear leg members 46 and 47 and, as shown, the rear leg members are not hinged directly in contact with the lateral seat members 16 and 17 for reasons to be explained. The forward arm support pair 53 has generally parallel right hand and left hand forward arm support members 54 and 55 which are thus hinged to the seat portion generally adjacent to forward hinge points to extend upwardly therefrom. The hinge points 50 and 51 have hinge pins 56 and 57 respectively, which are received in reinforced openings in the members, each pin having a length sufficient to pass through the three members stacked together. It can be seen that, on each side, the load of a person sitting on the chair is distributed across the pin between the lateral seat member, the forward arm support members and the rear leg members. The forward arm support pair 53 has a support connecting portion 59 extending between lower portions of the arm support members. The portion 59 is an inward extension of the members 54 and 55 which are thus in one piece, the portion 59 being positioned beneath the seat portion 13 so as to connect the forward arm support members together through bends 60 and 61 to form a relatively rigid, generally vertical, flat-bottomed 'U' shaped frame. The bends 60 and 61 are sufficiently generous to permit folding of the chair without undue interference with other members, as will be described, and the portion 59 is spaced well below the seat portion 13 so that sagging of the seat portion does not interfere with the portion 59.

An arm member pair 63 has generally horizontal right hand and left hand arm members 64 and 65 which are hinged adjacent forward portions thereof to upper ends of respective forward arm support members 54 and 55 and adjacent rear portions thereof to the lateral back members 22 and 23 respectively. Inverted 'U' shaped brackets 68 and 69 extend downwardly from adjacent forward portions of the arm members 64 and 65 and carry hinge pins 70 and 71 which hinge the brackets to the respective arm support members 54 and 55. Rear hinge pins 74 and 75 hinge rear portions of the arm members 64 and 65 to the lateral back members 22 and 23 respectively at a position adjacent to the lower edge of the back material 25. Right hand and left hand arm rests 76 and 77 have grooved lower surfaces to facilitate fitting along upper portions of the arm members 64 and 65. The arm members diverge slightly forwardly, which adds comfort when using the chair, but the divergence is mainly for clearance reasons necessary for folding, as will be described.

A right hand cross link 80 is hinged to extend between the right hand forward and right hand rear leg members 28 and 46 respectively, and a left hand cross link 81 similarly extends between left hand forward and left hand rear leg members 29 and 47 respectively. The cross link 80 has hinge pins 84 and 85 adjacent opposite ends thereof, that is adjacent forward and rear ends thereof, and the link 81 has similar hinge pins 86 and 87 adjacent forward and rear ends thereof. When viewed laterally, as seen in FIG. 2, the left hand forward and rear leg members appear to cross each other at an intersection 89, and it can be seen that the cross link 81 is positioned below the intersection of the respective leg members. Also, when the seat member 17 is generally horizontal, as best seen in FIG. 2, the cross link 81 is also generally horizontal, ie. parallel to the member 17. As best seen in FIG. 1, the forward and rear leg members only appear to cross each other when viewed laterally, because, as will be seen best in FIG. 3, they are in fact separated by a varying space equivalent to approximately one or two member's width assuming all members are made from a similar sized material. As also seen in FIG. 1, the right hand forward and rear leg members also appear to cross each other at an intersection 88 positioned above the cross link 80. The cross links are essentially non-resilient and are positioned sufficiently above lower portions of the leg members to permit the lower portions of the forward and rear leg members to move laterally relative to each other to permit folding as will be described.

The brief description following relates to approximate dimensions which refer to members on the left hand side only of the chair, but the same considerations apply to right hand side members due to symmetry of the chair. When the chair is in the position as shown in FIG. 2, the lateral seat member 17 is horizontal and the forward arm support member 55 is generally parallel to the lateral back member 23. Because the bracket 69 extends rigidly downwardly from the arm member 65, the location of the hinge pin 71 is located a distance 90 beneath the arm 65 and the location of the pin 71 determines the effective length of the arm support member 55. Spacing 91 between the hinge pins 71 and 57 as measured parallel to the arm support member 55 defines effective link length of the arm support member 55 where is connects the lateral seat member and the arm member. Spacing 92 between the hinge pins 75 and 38, is the spacing between the arm member 65 and the lateral seat member 17 at rear portions thereof and is defined as spacing associated with the lateral back member. It can be seen that spacing 91 between the hinge pins associated with the forward arm support member 55 is approximately equal to the spacing 92 between hinge pins associated with the lateral back members. The distance 90 increases spacing from the seat member at a forward end of the arm member 65, which member is generally parallel to the lateral seat member 17, although a slight downward and rearward slope of the arm member 65 results from the distance 90 and is preferable for comfort.

Similarly, spacing 94 between the hinge pins 71 and 75 is defined as spacing between hinge pins associated with the arm members and is clearly not measured parallel to the arm member 65 because the distance 90 between the hinge pin 71 and the member 65 inclines the spacing 94 to the arm member. Spacing 95 between the hinge pins 57 and 38 can be considered as effective length of the lateral seat members and is defined as spacing between hinge pins associated with the lateral seat member and this is approximately equal to the spacing 94.

Figure 7:
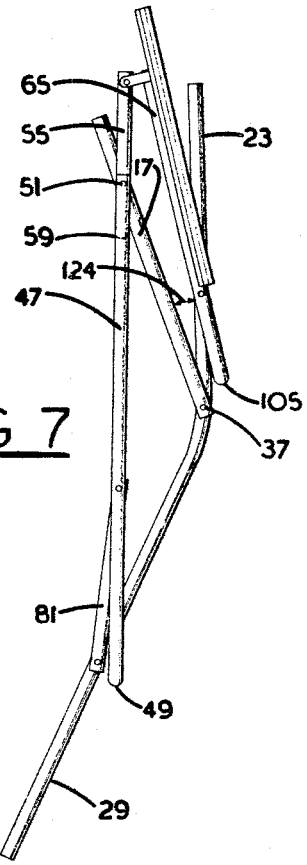
FIG. 7 is a simplified side elevation of the chair in a folded configuration.

It will be noted with reference to FIG. 7, that the 'U' shaped bracket 69 provides a simple and effective means of hinging the arm support member 55 to the arm member 65 to permit close folding therebetween. However, equivalent hinge means can be devised such that the hinge pin 71 could be disposed closer to the arm member 65, ie. the distance 90 could be made smaller thus permitting the arm members to form a closer approximation to a parallelogram than shown. However, the inclination of the arm members resulting from the distance 90 is acceptable and does not interfere unduly with use of the chair. It can be seen that the four members defined by the spaces between the hinge pins form a simple hinged "four-bar" mechanism which approximates to a parallelogram mechanism and is positioned above the seat portion.

The forward leg member 29 has a length 97 defined by spacing between a lower end 98 thereof and the hinge pin 38, and the rear leg member 47 has a length 99 defined by spacing between the lower end thereof, that is the transverse means 49, and the hinge pin 57. It can be seen that the forward and rear leg members have approximately equal lengths as defined above, which lengths are, in effect, measured between lower portions thereof in contact with the floor, and rear and forward hinge points respectively. The leg members are connected adjacent upper portions thereof by the lateral seat members and adjacent approximate mid-portions thereof by the cross links, thus forming a crossed four-bar link mechanism below the seat portion. In the position as shown in FIG. 2, the seat member 17 is inclined to the back member 23 at an angle 100 which is about 107 degrees but this angle can be varied, as will be described.

The chair can be formed from bent tubular members, for example aluminum alloy tubing or steel tubing of about one inch outside diameter. If the chair is formed from tubular members, it can be seen that the rear leg pair 45, the forward arm support pair 53 and the arm member pair 63 are simply generally flat-bottomed 'U' shaped tubes of generally pleasing proportions. Alternative materials, such as wood, plastics, etc. could be substituted with suitable structural changes.

Figure 3:
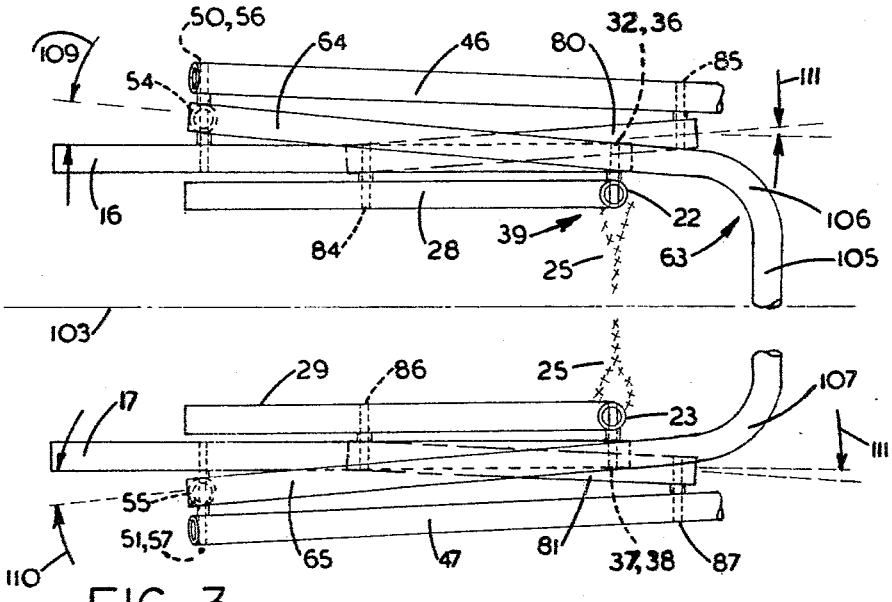
FIG. 3 is a simplified fragmented top plan of the chair in the intermedite operative position.
Figure 4:
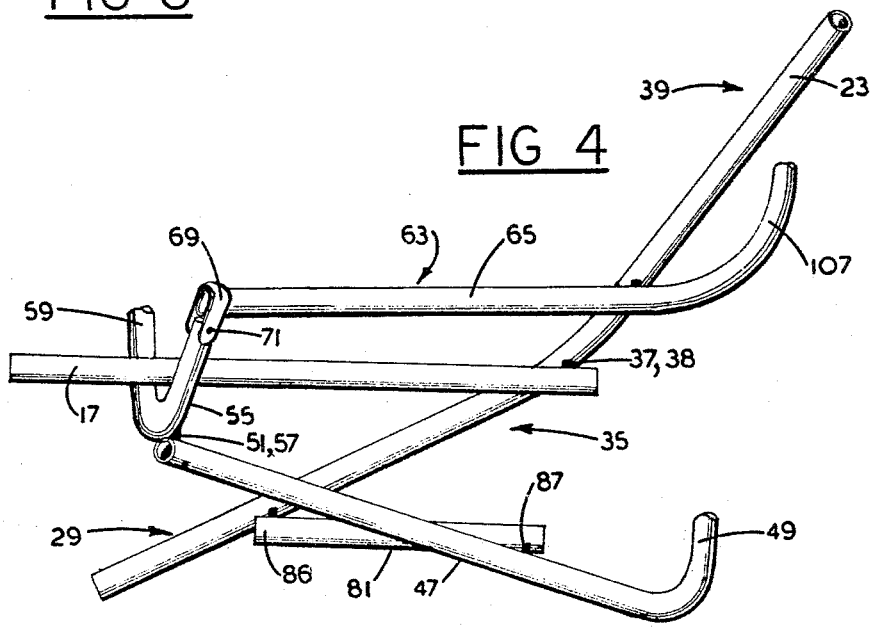
FIG. 4 is a simplified fragmented top perspective from an upper position of a portion of the chair in the intermediate position.

FIGS. 3 and 4

The chair 10 has a central plane designated by a central axis 103 and all members of the chair are symmetrical about this axis. The arm member pair 63 has an arm connecting portion 105 connected by bends 106 and 107 to the adjacent arm members 64 and 65 respectively. It can be seen that the portion 105 is spaced sufficiently from the back material 25 to prevent interference therewith when a person leans back on the chair and deforms the material. The bends 106 and 107 have a radii sufficient to permit the folding of the arm member pair relative to the 'H' shaped frame 39, so that it can assume a generally folded position, as will be described with reference to FIG. 7. As seen in FIG. 3, the lateral seat members 16 and 17 are generally parallel to each other and to the axis 103 and are positioned outwardly of adjacent lateral back members 22 and 23, and also inwardly of the right hand and left hand arm support members 54 and 55. Thus, each lateral seat member is hinged at the rear hinge point outwardly of the adjacent forward leg member, and at the forward hinge point is hinged inwardly of the adjacent forward arm support member. To maintain sufficient clearance between adjacent members to permit folding of the chair and to locate the forward ends of the arm members 64 and 65 directly above the arm support members 54 and 55 for connection to the 'U' shaped brackets, the arm members 64 and 65 diverge at shallow angles 109 and 110 to the axis 103. Thus outermost portions of the arm members are spaced further apart than innermost portions, which facilitates use of the chair as in common practice.

As best seen in FIG. 4, the front leg member 29 passes inwardly of the lateral seat member 17 adjacent to the rear hinge point 37, and inwardly of the pin 86 at a forward end of the cross link 81. In contrast, the rear leg member 47 passes outwardly of the seat member 17 and the arm support member 55 at the forward hinge point 51, and outwardly of the hinge pin 87 adjacent the rear end of the cross link 81. Thus it can be seen that each forward leg member is disposed inwardly of an adjacent rear leg member. This relative disposition of leg and seat member is to permit folding of the chair without interference between the members. It can be seen that the cross links 80 and 81 are inclined at equal angles 111 to the axis 103, which inclination is necessary to accommodate spacing between the adjacent leg members resulting from the above sandwiching of the lateral seat members by the front and rear leg members.

As best seen in FIG. 3, the rear leg members 46 and 47 diverge slightly from the lower portions to upper ends thereof and thus, for a given spacing at the upper end, reduce the angle 111 of the cross links to the axis, which reduces twisting loads on the hinge pins and other members. This is also considered to improve the appearance of the chair.

OPERATION

Figure 5:
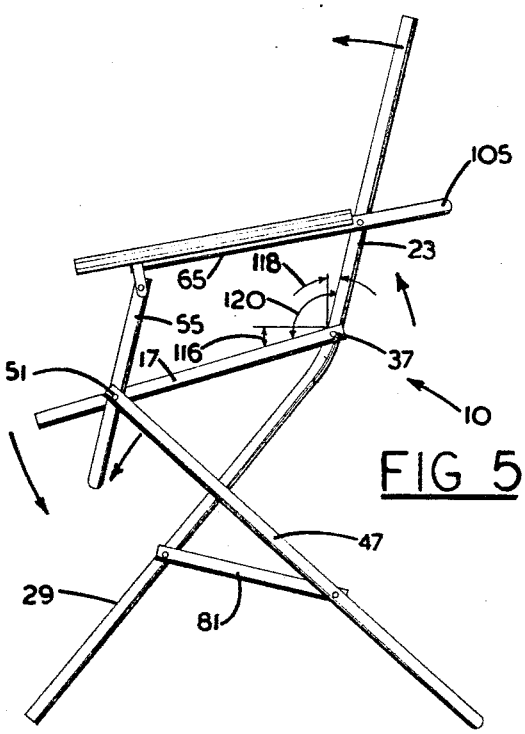
FIG. 5 is a simplified side elevation of the chair shown in an extreme forwardly inclined position.
Figure 6:
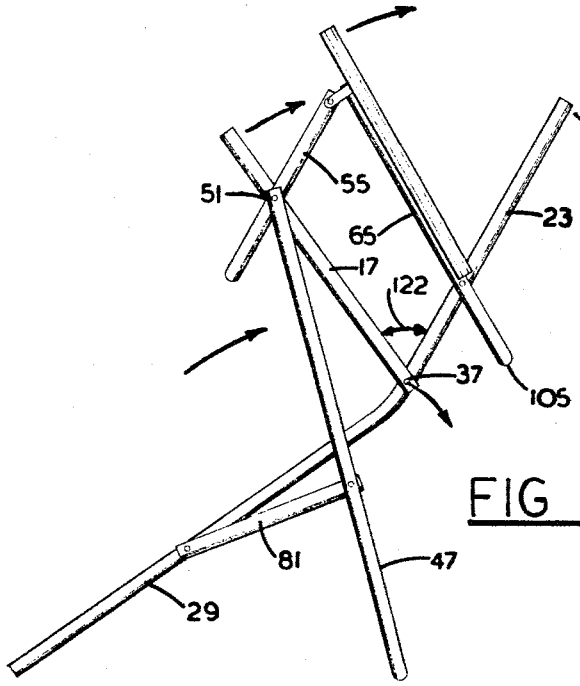
FIG. 6 is a simplified side elevation of the chair partially folded.

FIGS. 5 through 7

Referring to FIG. 5, the chair 10 is shown in an extreme forwardly inclined position in which the lateral seat member 17 is inclined downwardly and forwardly at an angle 116 to the horizontal. Undesignated arrows indicate direction of movement of various portions from the intermediate operative position of FIGS. 1 and 2. It is seen that the arm member 65 follows such movement permitting a person using the chair to stretch his legs out in an essentially straight line so that the person's upper and lower legs and the chair seat portion 13 are aligned. The arm member 65 is similarly inclined downwardly and forwardly at approximately the same inclination, whilst the lateral back member 23 is inclined to the vertical at an angle 118. Thus, the lateral seat member 17 and the lateral back member 23 are now inclined to each other at an angle 120 which is about 120 degrees. The angle 120 is greater than the angle 100 of FIG. 2 by about 13 degrees which permits the body to assume a more relaxed condition with the legs positioned as above described. It can be seen that the cross link 81 has now swung so that it is now no longer parallel to the lateral seat member 17 which swinging is to be expected with a crossed four-bar mechanism. A person using the chair can shift his position to change the chair's configuration from the FIG. 2 to FIG. 5 configuration without rising from the chair, which is a convenience and comfort advantage. The center of gravity of the person will not have shifted materially fore or aft relative to base of the chair as defined by spacing between lower portions of the front and rear leg members and thus accidental tipping of the chair is unlikely. It is noted that, in the position of FIG. 5, the small of the back of the user is supported to some extent by the back portion 14 which relieves back strain and contrasts with many prior art chairs.

Referring to FIG. 6, the chair is in a partially folded position in which undesignated arrows show movement of members from the FIG. 2 configuration. The forward leg member 29 is shown swinging downwardly toward the horizontal, and the rear leg member 47 swings upwardly towards the vertical. Simultaneously, the arm support members and seat members swing relative to each other so that the angle 100, FIG. 2, between the lateral seat member and lateral back member becomes more acute to become an angle 122. Clearly, FIG. 6 is a partially folded position of the chair and is not intended for sitting.

Various intermediate positions between the positions shown in FIG. 5 and FIG. 6 can be attained by the person using the chair pushing with his feet or shifting his weight by other means, thus causing the lateral seat members to swing about the general horizontal intermediate position of FIGS. 1 and 2. The person can adjust his position in the chair as required for comfort and without rising from the chair. For normal movements of the lateral seat members which might be about 40 degrees total, the center of gravity of the user does not shift materially and thus accidental collapse of the chair is unlikely to occur for a reasonable range of movements of the seat members. Thus, in summary, the chair is inherently more stable than some folding chairs of the prior art, provides adequate support for the small of the back of the user for most positions and does not require the user to rise from the chair, make adjustments, and then sit down again.

Further movement of the leg members in the direction shown in FIG. 6 results in the chair assuming a folded or partially flattened position as shown in FIG. 7. In this position the lateral seat and back members 17 and 23 are inclined to each other at an angle 124 which is about 20 degrees. Further folding of the mechanism is prevented by interference of the bends 106 and 107 adjacent the connecting portion 105 of the arm member pair 63 with the lateral back member 23, and also interference of the bends 60 and 61 adjacent the portion 59 with the lateral seat members 16 and 17. Clearly, if the connecting portion 105 and the connecting portion 59 were spaced further from the hinge pins, limited additional swinging of the mechanism could take place but this would result in a chair that is considered to be less pleasing aesthetically. In any event, interference between other hinging members would likely occur, eg. the means 49 interfering with the leg members 28 and 29 thus preventing further closure of the mechanism.

It can be seen that, in the folded state of the chair of FIG. 7, the arm members and lateral seat members remain generally parallel to each other, and the forward arm support members and the lateral back members also remain generally parallel to each other. This permits the main portions of the four-bar mechanism of the chair to assume a generally flattened parallelogram shape as seen in FIG. 7. Clearly the small inequality in spacing between hinge pins associated with opposite members prevents the mechanism from acting as a true "four-bar" parallelogram mechanism, but the approximation to a parallelogram permits closing of the chair to a shape that is considered flatter than that commonly found in some folding chairs. Clearly a more flattened shape facilitates storage of the chair in limited spaces.

By comparing FIGS. 5 and 6, it can be seen that the seat member 17 swings through a greater angle than the back member 23 for the two exaggerated extreme seat positions shown. This differential movement results in a relatively wide variation of seat member inclination and a correspondingly relatively narrow variation in back member inclination, which is desirable for comfort in a variable geometry chair such as this. This differential movement results from the crossed four bar mechanism below the seat member 17 because this mechanism causes the ends of the seat member to move in opposite directions in response to swinging of the forward and rear leg members about their lower end. The opposite movements magnify angular movement of the leg members and, because the forward leg member is extended as the back member, the back member thus experiences less angular movement than the seat member.

It is noted that spacing between hinge pins on the cross link 81 is shorter than spacing between hinge pins of the seat member. This is required, because to permit the cross link 81 to attain the folded position shown in FIG. 7, the cross link must swing through a greater angle than the seat member and thus must be shorter.

I claim:

1. A folding chair structure having legs, a seat portion and a back portion; the structure being adapted to be unfolded from a folded position to an operative position in which the seat portion includes generally horizontal right hand and left hand lateral seat members adapted to support seat material extending therebetween, and the back portion includes upwardly extending right hand and left hand lateral back members hinged to the respective seat members and adapted to support back material extending therebetween, the chair being characterized by:

(a) a forward leg pair having right hand and left hand inclined, generally parallel forward leg members extending upwardly and rearwardly from a position generally below a forward portion of the seat portion to be hinged at aligned rear hinge points generally adjacent a rear portion of the seat portion, the forward leg members extending essentially rigidly from the respective lateral back members adjacent the rear hinge point so as to be inclined at an obtuse angle to the back members to form right hand and left hand combination members, first transverse means connecting the combination members together, (b) a rear leg pair having right hand and left hand inclined, generally parallel rear leg members extending upwardly and forwardly from a position generally beneath the rear portion of the seat portion to be hinged at aligned forward hinge points adjacent the forward portion of the seat portion, a second transverse means connecting the rear leg members together, and when viewed laterally, the forward and rear leg members appearing to cross each other at an intersection, (c) right hand and left hand essentially non-resilient cross links, the right hand cross link being hinged to extend between the right hand forward and right hand rear leg members, and the left hand cross link hinged to extend between the left hand forward and left hand rear leg members respectively, the cross links being positioned below the intersection of the respective leg members, and sufficiently above lower portions of the leg members to permit the lower portions of forward and rear leg members to move laterally relative to each other.

(d) a forward arm support pair having generally parallel right hand and left hand forward arm support members hinged to the seat portion generally adjacent the forward hinge points to extend upwardly therefrom, (e) an arm member pair having generally horizontal right hand and left hand arm members hinged adjacent forward portions thereof to the respective forward arm support members and adjacent rear portions thereof to the respective lateral back members.

2. A folding chair as claimed in claim 1 in which:

(a) the arm member pair has an arm connecting portion extending between rear portions of the arm members and positioned rearwardly of the back portion of the chair, so as to connect the arm members together to form a relatively rigid, generally horizontal, flat-bottomed 'U' shaped frame.

3. A folding chair structure as claimed in claim 1 in which:

(a) the forward arm support members have a support connecting portion extending between lower portions of the arm support members and positioned beneath the seat portion, so as to connect the forward arm support members together to form a relatively rigid, generally vertical, flat-bottomed 'U' shaped frame.

4. A folding chair structure as claimed in claim 1 in which:

(a) the first transverse member extends between upper portions of the right hand and left hand forward leg members to connect together rigidly the forward leg members generally below the seat portion to form an inclined, generally 'H' shaped frame with the lateral back members forming an upper portion of the 'H' shaped frame and the forward leg portions forming a lower portion of the frame.

5. A folding chair structure as claimed in claim 1 in which:

(a) the chair is formed from tubular members, (b) the forward arm support pair and the arm member pair are formed from generally flat-bottomed 'U' shaped tubes.

6. A folding chair structure as claimed in claim 1 in which:

(a) the second transverse means is an inward extension of the rear leg members to connect the rear leg members together adjacent lower portions thereof to form a generally flat-bottomed 'U' shaped frame.

7. A folding chair structure as claimed in claim 1 in which:

(a) the right hand and left hand forward leg members are integral with the right hand and left hand lateral back members of the seat portions, each leg member being inclined to the respective back member at an angle of between 145 degrees and 165 degrees to form shallow 'V' shaped continuous combination members.

8. A folding chair structure as claimed in claim 1 in which:

(a) each forward leg member is disposed inwardly of an adjacent rear leg member, (b) each lateral seat member is hinged at the rear hinge point outwardly of the adjacent forward leg member, and at the forward hinge point inwardly of the adjacent forward arm support member.

9. A folding chair structure as claimed in claim 1 in which, when the chair is viewed laterally in the operative position:

(a) the forward arm support members are generally parallel to the lateral back members, (b) the arm members are generally parallel to the lateral seat members.

10. A folding chair structure as claimed in claim 1 in which:

(a) the forward and rear leg members have essentially equal lengths, as measured between lower portions thereof and the rear and forward hinge points respectively, (b) spacing between hinge pins associated with the forward arm support members is approximately equal to spacing between hinge pins associated with the lateral back members, (c) spacing between hinge pins associated with the arm members is approximately equal to spacing between hinge pins associated with the lateral seat portions, so as to define a four-bar mechanism approximating to a parallelogram, so that when the chair is folded the arm members and the lateral seat members remain generally parallel to each other, and the forward arm support members and the lateral back members also remain generally parallel to each other, thus permitting the folded chair to assume a generally flattened shape.

11. A folding chair structure as claimed in claim 1 in which:

(a) an inverted 'U' shaped bracket extends downwardly from each forward portion of the arm members, (b) a hinge pin is carried in each bracket to hinge the brackets to the respective arm support members.

* * * * *